US012692758B2

(12) United States Patent
Katanguri et al.

(10) Patent No.: US 12,692,758 B2
(45) Date of Patent: Jul. 28, 2026

(54) APPARATUS AND METHODS FOR ELECTRIC POWER MANAGEMENT

(71) Applicant: Schlumberger Technology Corporation, Sugar Land, TX (US)

(72) Inventors: Suman Katanguri, Sugar Land, TX (US); Matthew Givens, Houston, TX (US); Matthew Olson, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 713 days.

(21) Appl. No.: 18/299,489

(22) Filed: Apr. 12, 2023

(65) Prior Publication Data

US 2024/0344443 A1 Oct. 17, 2024

(51) Int. Cl.

| | |
|---|---|
| ***E21B 44/06*** | (2006.01) |
| ***E21B 4/04*** | (2006.01) |
| ***E21B 21/08*** | (2006.01) |
| ***E21B 33/035*** | (2006.01) |
| ***E21B 33/06*** | (2006.01) |
| ***E21B 34/16*** | (2006.01) |

(52) U.S. Cl.

CPC ..... *E21B 21/08* (2013.01); *E21B 33/0355* (2013.01); *E21B 33/06* (2013.01); *E21B 34/16* (2013.01); *E21B 44/06* (2013.01)

(58) Field of Classification Search

CPC ..... E21B 21/08; E21B 33/06; E21B 2200/22; E21B 43/2401; E21B 34/066; E21B 47/12; E21B 34/16; E21B 33/0355; E21B 41/0085; H01M 10/46; H01M 2220/10; F04B 17/03; F04B 49/065; F04B 51/00

See application file for complete search history.

(56) References Cited

U.S. PATENT DOCUMENTS

| | | | | |
|---|---|---|---|---|
| 1,153,024 | A | 9/1915 | Brown | |
| 10,450,811 | B2 * | 10/2019 | Roodenburg | E21B 19/143 |
| 11,313,206 | B2 | 4/2022 | Fripp | |
| 11,407,327 | B1 * | 8/2022 | Kohn | B60L 50/40 |
| 11,486,788 | B2 * | 11/2022 | Haslanger | G01M 3/26 |
| 11,513,024 | B2 | 11/2022 | Rogers et al. | |
| 11,555,372 | B1 | 1/2023 | Al-Mousa | |
| 12,404,736 | B2 | 9/2025 | Katanguri | |
| 2010/0060231 | A1 * | 3/2010 | Trainor | H01M 10/46 320/103 |

(Continued)

FOREIGN PATENT DOCUMENTS

| | | | |
|---|---|---|---|
| CN | 107355193 | A | 11/2017 |
| CN | 207111033 | U | 3/2018 |

(Continued)

OTHER PUBLICATIONS

English translation of KR20160016094A (Year: 2026).*

(Continued)

*Primary Examiner* — Dominick L Plakkoottam
(74) *Attorney, Agent, or Firm* — Kyle R. Miiller

(57) ABSTRACT

A system includes a pressure control equipment and a hydraulic power unit including a fluid reservoir, and at least one pump including an electric motor configured to power the pump. The at least one pump of the hydraulic power unit is in direct fluidic communication with the pressure control equipment.

15 Claims, 4 Drawing Sheets

(56) References Cited

U.S. PATENT DOCUMENTS

| | | | | |
|---|---|---|---|---|
| 2014/0069351 | A1 | 3/2014 | Stratton | |
| 2014/0311735 | A1 | 10/2014 | Landrith | |
| 2015/0152705 | A1 | 6/2015 | Jaffrey | |
| 2015/0308212 | A1 | 10/2015 | Maunus | |
| 2015/0320265 | A1* | 11/2015 | Bullock | A47K 5/1217 222/1 |
| 2016/0265300 | A1 | 9/2016 | Affleck | |
| 2016/0326826 | A1 | 11/2016 | Wood | |
| 2017/0170675 | A1* | 6/2017 | Ni Scanaill | H02J 7/865 |
| 2017/0211327 | A1* | 7/2017 | Wern | E21B 19/16 |
| 2017/0226813 | A1* | 8/2017 | Northam | E21B 47/06 |
| 2018/0010411 | A1 | 1/2018 | Kroesen | |
| 2018/0073320 | A1 | 3/2018 | Holmes | |
| 2018/0347710 | A1 | 12/2018 | Whitby | |
| 2019/0003275 | A1 | 1/2019 | Deul | |
| 2019/0032436 | A1 | 1/2019 | Daley | |
| 2019/0078426 | A1* | 3/2019 | Zheng | E21B 44/00 |
| 2019/0229591 | A1 | 7/2019 | Hjertvikrem | |
| 2019/0368299 | A1* | 12/2019 | Jorud | E21B 34/066 |
| 2020/0284274 | A1 | 9/2020 | van Kuilenburg | |
| 2020/0347714 | A1* | 11/2020 | Kilic | E21B 47/12 |
| 2020/0370988 | A1* | 11/2020 | Rogers | F04B 15/02 |
| 2021/0277768 | A1 | 9/2021 | Wu | |
| 2021/0381332 | A1 | 12/2021 | Dhamodaran | |
| 2022/0056778 | A1* | 2/2022 | Olson | F04B 23/04 |
| 2022/0074297 | A1* | 3/2022 | Zheng | E21B 41/00 |
| 2022/0136356 | A1 | 5/2022 | Poveda | |
| 2022/0145730 | A1 | 5/2022 | Benson | |
| 2022/0195848 | A1 | 6/2022 | Olson | |
| 2022/0228455 | A1 | 7/2022 | Pujol | |
| 2022/0251918 | A1 | 8/2022 | Berthaud | |
| 2022/0389784 | A1 | 12/2022 | Katanguri | |
| 2023/0127022 | A1 | 4/2023 | Egbe | |
| 2023/0198295 | A1* | 6/2023 | Wyman | H02J 13/12 166/65.1 |
| 2023/0205239 | A1* | 6/2023 | Olson | G05D 16/208 137/12 |
| 2024/0010320 | A1* | 1/2024 | Kusiak | B63J 3/04 |
| 2024/0344918 | A1 | 10/2024 | Katanguri | |
| 2024/0384618 | A1 | 11/2024 | Katanguri | |
| 2025/0376907 | A1 | 12/2025 | Katanguri | |

FOREIGN PATENT DOCUMENTS

| | | | | |
|---|---|---|---|---|
| CN | 116220605 | B | 8/2023 | |
| EP | 3077612 | B1 | 5/2020 | |
| KR | 20160016094 | A * | 2/2016 | B63H 21/17 |
| KR | 102153626 | B1 * | 9/2020 | B60W 10/26 |
| NO | 341435 | B1 | 11/2017 | |
| WO | 2014147406 | A2 | 9/2014 | |
| WO | 2019158723 | A1 | 8/2019 | |
| WO | 2020153961 | A1 | 7/2020 | |
| WO | 2020169714 | A1 | 8/2020 | |
| WO | 2021178817 | A1 | 9/2021 | |
| WO | 2022159567 | A1 | 7/2022 | |
| WO | 2022173914 | A1 | 8/2022 | |

OTHER PUBLICATIONS

English Translation plus original of KR102153636 (Year: 2026).*
Search Report and Written Opinion of International Patent Application No. PCT/US2024/023665 dated Jul. 18, 2024, 12 pages.
Search Report and Written Opinion of International Patent Application No. PCT/US2024/022579 dated Jul. 23, 2024, 10 pages.
Search Report and Written Opinion of International Patent Application No. PCT/US2024/029598 dated Sep. 6, 2024, 11 pages.
Office Action issued in U.S. Appl. No. 18/318,197 dated Sep. 30, 2024, 8 pages.
Beim et al, "Improving Performance—Electrification of Well Control Equipment", IADC/SPE-212506-MS, SPE/IADC International Drilling Conference and Exhibition, Mar. 2023, 10 pages.
Givens et al., "Pressure On-Demand—Hybrid Electric BOP Control Systems", IADC/SPE-212555-MS, SPE/IADC International Drilling Conference and Exhibition, Mar. 2023, 8 pages.

* cited by examiner

APPARATUS AND METHODS FOR ELECTRIC POWER MANAGEMENT

BACKGROUND

Drilling rigs are used to bore into the earth to create a well and then to complete and extract hydrocarbons from the well. Drilling rigs include various mechanical devices to accomplish these functions, such as draw works, top drives, pumps, etc., which may be powered electrically. The drilling rigs also include electrical components such as control panels, sensors, processors, etc., also powered by electricity. Where available, such electrical power is provided by connection to a power grid. However, land rigs may be positioned in remote locations, where grid access may be unavailable or for other reasons difficult to obtain. Providing power lines running to offshore rigs may likewise not be an option. Accordingly, diesel generators are used in such situations to power the rig.

Safety equipment is also provided on the drilling rigs. Generally, this safety equipment is configured to operate even in the absence of an active source of electrical power, e.g., the connection to the grid is interrupted, the generators go offline, etc. Moreover, the safety equipment may call for power at a greater rate than is practical for the electrical power source to provide on demand. Accordingly, the safety equipment may be powered using stored hydraulic energy. For example, hydraulic accumulators may be provided, and hydraulic fluid may be pumped into the accumulators at high pressure when power is available. In an emergency event, the energy stored in the accumulators may be delivered rapidly to the safety equipment, even if electrical power has been lost.

A blowout preventer (BOP) provides an example of such safety equipment. A BOP positioned at the wellhead may have one or more rams that are configured to shear a tubular extending therethrough, thereby preventing fluid from escaping from the well into the ambient environment in an emergency situation. In the event of a power loss, valves are operated to direct stored hydraulic fluid from the accumulators to the shear rams, which in turn actuate and seal the BOP.

However, as wells become more complex and BOP stacks become larger, the size of the accumulators called for to deliver the large amounts of energy used to actuate the shear rams can present a challenge. In offshore contexts, rig space is at a high premium, and thus it may be desirable to avoid devoting large portions of the rig to emergency accumulators. In land-based drilling, such large accumulators can present a transportation and space issue as well. Moreover, usable volume constraints set forth from API regulations require additional and/or larger accumulators to meet system requirements. Accordingly, there is a need to replace BOP accumulator systems with more efficient, cost competitive, battery powered pumping systems to overcome usable volume constraints and ever-increasing BOP shear requirements.

SUMMARY

According to one or more embodiments of the present disclosure, a system includes a pressure control equipment, and a hydraulic power unit including: a fluid reservoir, and at least one pump including an electric motor configured to power the pump, wherein the at least one pump of the hydraulic power unit is in direct fluidic communication with the pressure control equipment.

According to one or more embodiments of the present disclosure, a system includes a pressure control equipment including an electric motor, and a control panel including a drive controller, wherein the drive controller drives the electric motor of the pressure control equipment.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

In general, embodiments of the present disclosure may avoid or reduce the dependency on hydraulic accumulators in drilling rigs. More specifically, one or more embodiments of the present disclosure includes a power management system connected to a controller of a pressure control equipment. According to one or more embodiments of the present disclosure, the power management system may include a capacitor management system connected to a supercapacitor to support higher power demands of the pressure control equipment, and a stored electrical system to support normal operations of the pressure control equipment.

Figure 1A:
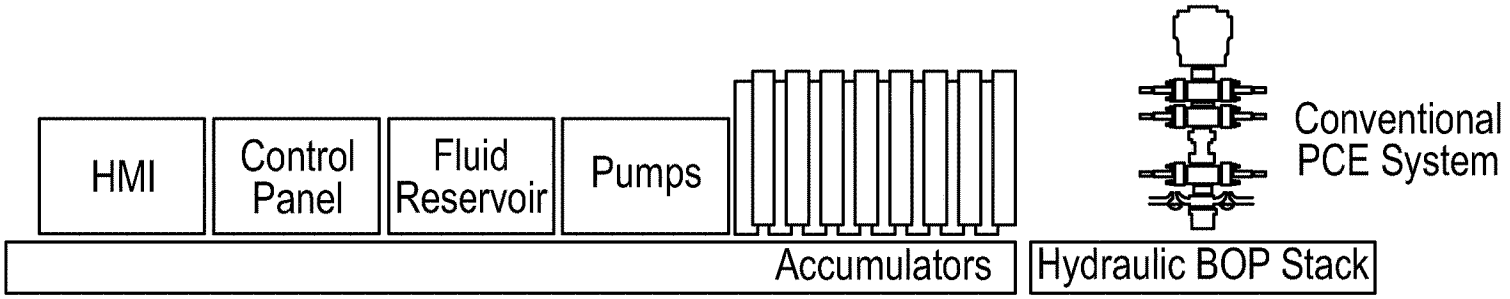
FIG. 1A shows a conventional pressure control equipment system.

Referring now to FIG. 1A, a conventional pressure control equipment system is shown. As shown, the conventional pressure control equipment system includes hydraulic accumulators so that stored hydraulic energy may be delivered rapidly to the hydraulic BOP stack in an emergency situation, even if electrical power has been lost.

Figure 1B:
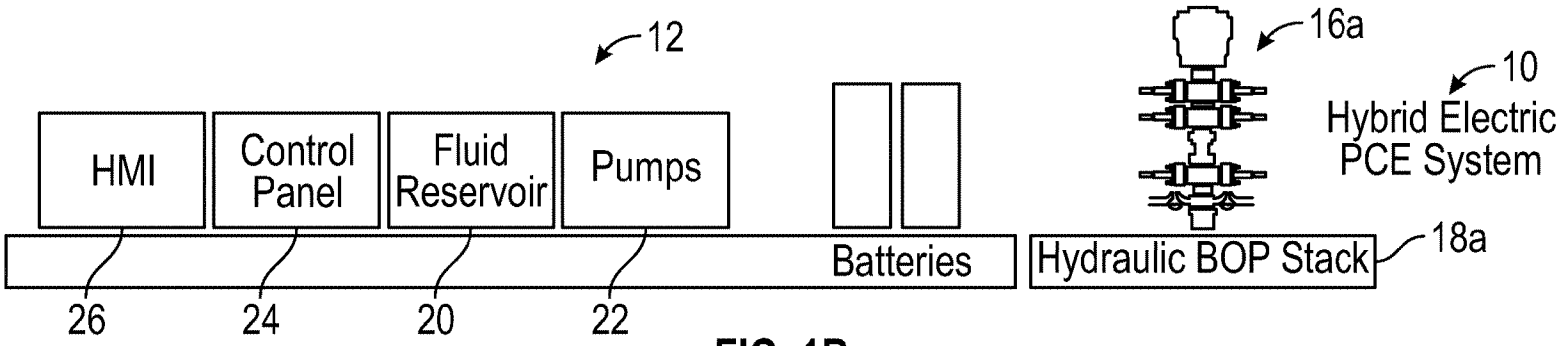
FIG. 1B shows a hybrid electric pressure control equipment system according to one or more embodiments of the present disclosure.
Figure 1C:
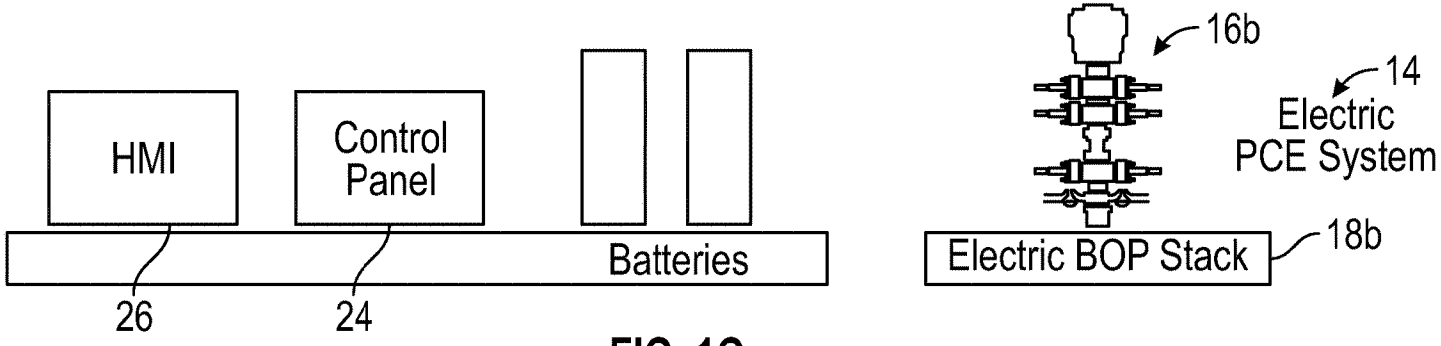
FIG. 1C shows an electric pressure control equipment system according to one or more embodiments of the present disclosure.

Referring now to FIGS. 1B and 1C, electric pressure control equipment systems are shown in which the hydraulic accumulators of the conventional pressure control equipment system of FIG. 1A have been replaced with a power management system, which may include at least one battery, according to one or more embodiments of the present disclosure. Specifically, FIG. 1B shows a hybrid electric pressure control equipment system 10 that includes a hydraulic power unit 12 and a pressure control equipment 16*a* according to one or more embodiments of the present disclosure, and FIG. 1C shows an electric pressure control equipment system 14 that includes a pressure control equipment 16*b* having an electric motor, according to one or more embodiments of the present disclosure. The hybrid electric pressure control equipment system 10 of FIG. 1B and the electric pressure control equipment system 14 of FIG. 1C are further described below.

In view of FIG. 1B, the pressure control equipment 16*a* of the hybrid electric pressure control equipment system 10 according to one or more embodiments of the present disclosure includes a blowout preventer stack, such as a hydraulic blowout preventer stack 18*a*, for example. As other examples, the pressure control equipment 16*a* may also include a diverter or choke/kill valves without departing from the scope of the present disclosure. As previously described, the hybrid electric pressure control equipment system 10 also includes a hydraulic power unit 12. According to one or more embodiments of the present disclosure, the hydraulic power unit 12 includes a fluid reservoir 20, and at least one pump 22 having an electric motor configured to power the at least one pump 22. In the hybrid electric pressure control equipment system 10, the at least one pump 22 of the hydraulic power unit 12 is in direct fluidic communication with the pressure control equipment 16*a*, according to one or more embodiments of the present disclosure.

According to one or more embodiments of the present disclosure, the hybrid electric pressure control equipment system 10 also includes a programmable logic controller (PLC) in electric communication with the hydraulic power unit 12 that is configured to evaluate a power need of the hydraulic power unit 12. The PLC may be included in the control panel 24 of the hybrid electric pressure control equipment system 10, for example. The PLC may include a memory and processing circuitry. The memory may include volatile memory, such as random-access memory (RAM), and/or non-volatile memory, such as read-only memory (ROM), optical drives, hard disc drives, solid-state drives, or any other non-transitory computer-readable medium that includes instructions executable by the processing circuitry. According to one or more embodiments of the present disclosure, the processing circuitry may include one or more application specific integrated circuits, one or more field programmable gate arrays, one or more processors, or any combination thereof, configured to execute the instructions stored in the memory, such as to control operations to utilize the power management system of the hybrid electric pressure control equipment system 10 according to the power need of the hydraulic power unit 12, as further described below. As shown in FIG. 1B, the hybrid electric pressure control equipment system 10 may also include a human machine interface (HMI) 26 connected to the PLC of the control panel 24, for example.

In view of FIG. 1C, the pressure control equipment 16*b* of the electric pressure control equipment system 14 according to one or more embodiments of the present disclosure includes a blowout preventer stack, such as electric blowout preventer stack 18*b*, for example. As other examples, the pressure control equipment 16*b* may also include a diverter or choke/kill valves without departing from the scope of the present disclosure. As previously described, the electric pressure control equipment system 14 according to one or more embodiments of the present disclosure includes a pressure control equipment 16*b* having an electric motor. According to one or more embodiments of the present disclosure, the electric pressure control equipment system 14 includes a control panel 24 having a drive controller, for example. In the electric pressure control equipment system 14 according to one or more embodiments of the present disclosure, the drive controller drives the electric motor of the pressure control equipment 16*b*. According to one or more embodiments of the present disclosure, the drive controller of the control panel 24 includes a solid-state starter (i.e., a "soft starter," as known by those having ordinary skill in the art) and/or a variable frequency drive that is configured to control inrush current to the electric motor of the pressure control equipment 16*b*.

In addition to the drive controller, the control panel 24 of the electric pressure control equipment system 14 according to one or more embodiments of the present disclosure may also include a PLC that is configured to evaluate a power need of the pressure control equipment 16*b*. The PLC may include a memory and processing circuitry. The memory may include volatile memory, such as random-access memory (RAM), and/or non-volatile memory, such as read-only memory (ROM), optical drives, hard disc drives, solid-state drives, or any other non-transitory computer-readable medium that includes instructions executable by the processing circuitry. According to one or more embodiments of the present disclosure, the processing circuitry may include one or more application specific integrated circuits, one or more field programmable gate arrays, one or more processors, or any combination thereof, configured to execute the instructions stored in the memory, such as to control operations to utilize the power management system of the electric pressure control equipment system 14 according to the power need of the pressure control equipment 16*b*, as further described below. As shown in FIG. 1C, the electric pressure control equipment system 14 may also include an HMI 26 connected to the PLC of the control panel 24, for example.

Figure 2:
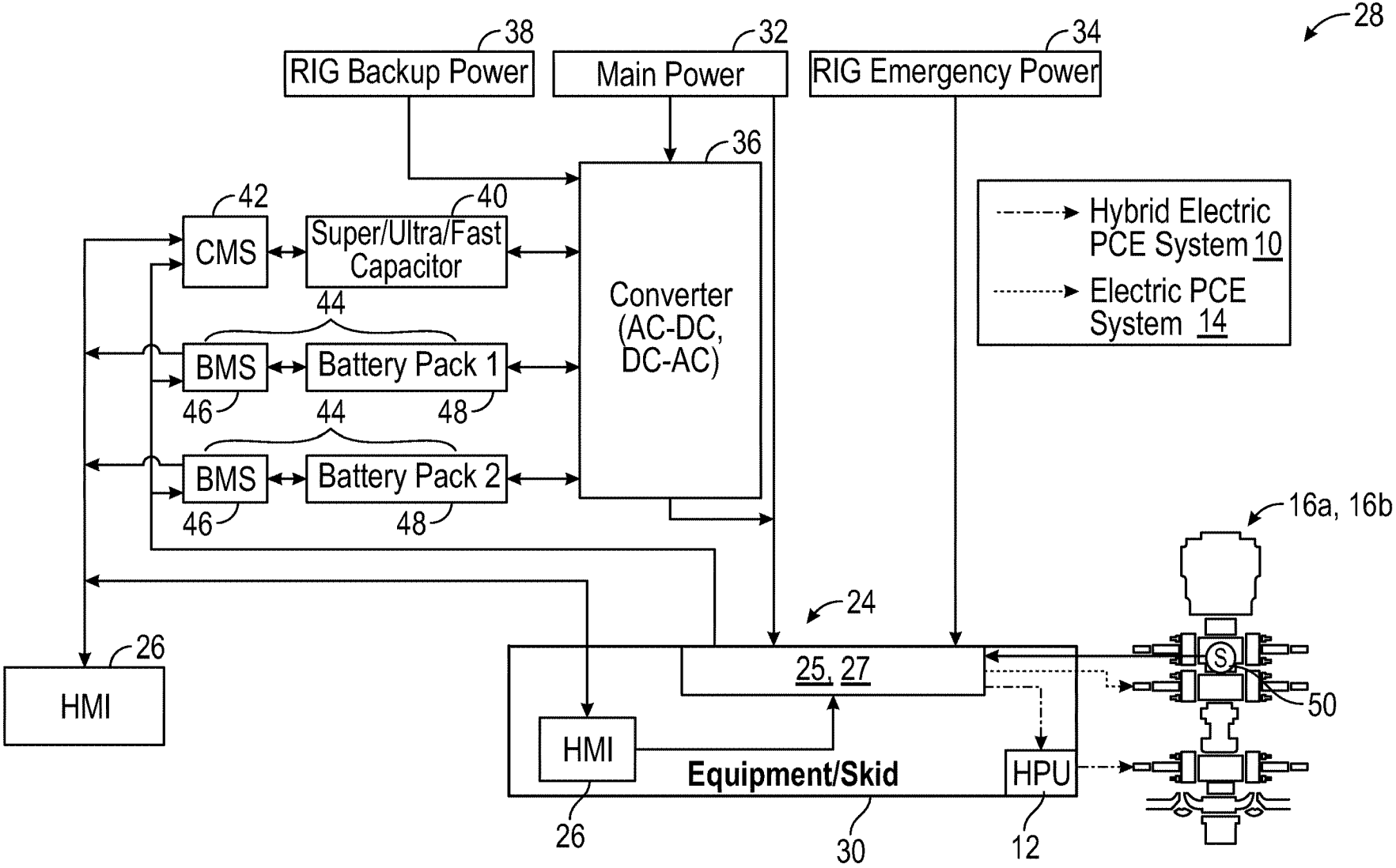
FIG. 2 shows a schematic diagram of an electric power management system according to one or more embodiments of the present disclosure.

Referring now to FIG. 2, a schematic diagram of a power management system 28 according to one or more embodiments of the present disclosure is shown. As shown in FIG. 2, the power management system 28 may include a platform or skid 30 with equipment mounted on the skid 30. According to one or more embodiments of the present disclosure, equipment mounted on the skid 30 may include a control panel 24, which may include the PLC 25 as previously described, and at least one starter 27 connected to the PLC 25. An HMI 26 may also be mounted on the skid 30, the HMI 26 being connected to the PLC 25 of the control panel 24, for example. According to one or more embodiments of the present disclosure, the power management system 28 is connected to the control panel 24, as further described below.

Still referring to FIG. 2, the power management system 28 according to one or more embodiments of the present disclosure may include a main power source 32 for supplying alternating current (AC) power directly to the control panel 24 mounted on the skid 30, for example. Specifically, the AC power may be supplied to one or both of the PLC 25 and the at least one starter 27 of the control panel 24, for example. As further shown in FIG. 2, the power management system 28 according to one or more embodiments of the present disclosure may also include a converter 36 for supplying AC power to the control panel 24 mounted on the skid 30, for example. As an alternative power source, the power management system 28 according to one or more embodiments of the present disclosure may also include backup power 38 from the rig, for example. According to one or more embodiments of the present disclosure, the rig backup power 38 supplies AC power to the converter 36. Then, the converter 36 may convert the AC power to DC power for storage within the power management system 28, as further described below. Thereafter, the converter 36 may reconvert the DC power to AC power to be supplied directly to the control panel 24 mounted on the skid 30. In this way, the rig backup power 38 supplies power to the converter 36 when the main power source 32 fails, according to one or more embodiments of the present disclosure.

Still referring to FIG. 2, the power management system 28 according to one or more embodiments of the present disclosure may also include rig emergency power 34 to supply AC power directly to the control panel 24 in the event of an emergency. As an example, the emergency bus that supplies the rig emergency power 34 will have a backup emergency generator, which will activate and be ready for use as a power source in the event of a rig blackout.

As previously described, the hydraulic power unit 12 according to one or more embodiments of the present disclosure includes a fluid reservoir 20, and at least one pump 22 having an electric motor configured to power the at least one pump 22. According to one or more embodiments of the present disclosure, the electric motor of the hydraulic power unit 12 is fed by the at least one starter 27 of the control panel 24. According to one or more embodiments of the present disclosure, the at least one starter 27 may include at least one of a solid-state starter, a Fine Voltage Non-Reversing (FVRN) starter, and a variable frequency drive that is designed to limit inrush current to the electric motor of the hydraulic power unit 12 so as to not overload the applicable power source (i.e., rig backup power 30, main power 32, or rig emergency power 34), for example. According to one or more embodiments of the present disclosure, the hydraulic power unit 12 may include a backup pump along with a backup starter in the event of a failure of one or more of the at least one starter 27, the at least one pump 22, or the electric motor, for example.

According to one or more embodiments of the present disclosure, incoming power is fed into the power management system 28 via an automatic transfer scheme at a plurality of inputs. If power is lost to the main power source 32, for example, the power management system 28 will automatically transfer to another feed. Electrical distribution boxes within the power management system 28 are redundant, and the power management system 28 can operate without one of them once cables are moved accordingly.

As previously described, in the power management system 28 according to one or more embodiments of the present disclosure, the main power source 32 may supply AC power directly to the control panel 24 mounted on the skid 30, as shown in FIG. 2, for example. In other embodiments of the present disclosure, the main power source 32 may supply AC power to the converter 36 of the power management system 28. According to one or more embodiments of the present disclosure, the converter 36 may be a bi-directional converter. For example, AC power supplied to the converter 36 by the main power source 32 may be converted to DC power for storage within the power management system 28. Then, the stored DC power may be supplied back to the converter 36, where it is reconverted to AC power for supply to the control panel 24 mounted on the skid 30. In order to store the DC power, the power management system 28 according to one or more embodiments of the present disclosure includes a supercapacitor 40 electrically connected to the converter 36, as shown in FIG. 2, and as further described below. Advantageously, the supercapacitor 40 according to one or more embodiments of the present disclosure is able to support rapid and high energy demands of the power management system 28. According to one or more embodiments of the present disclosure, the power management system 28 may also include a stored electrical energy system 44 electrically connected to the converter 36 for storing DC power, as also shown in FIG. 2 for example, and as further described below. The stored electrical energy system 44 according to one or more embodiments of the present disclosure is able to support normal and non-emergency energy demands of the power management system 28.

Still referring to FIG. 2, the power management system 28 according to one or more embodiments of the present disclosure may also include a capacitor management system 42 connected to the supercapacitor 40. According to one or more embodiments of the present disclosure, the capacitor management system 42 may also be in communication with the HMI 26 mounted on the skid and/or to an additional HMI 26 that is not mounted to the skid 30, as shown in FIG. 2. According to one or more embodiments of the present disclosure, either or both of the HMIs 26 may be configured to operate in a safe rated area, a hazardous rated arca, or a combination of these.

As also shown in FIG. 2, the PLC 25 of the control panel 24 mounted on the skid 30 is configured to send instructions for controlling the capacitor management system 42 according to one or more embodiments of the present disclosure. In operation, for example, the PLC 25 is configured to evaluate a power need of the hydraulic power unit 12 of the hybrid electric pressure control equipment system 10. According to one or more embodiments of the present disclosure, the PLC 25 is configured to send instructions to the capacitor management system 42 to discharge the supercapacitor 40 if the power need of the hydraulic power unit 12 exceeds a predetermined threshold. According to one or more embodiments of the present disclosure, the predetermined threshold may be substantially equal to a power rating or an available power amount of any of the main power source 32, the rig backup power 38, or the rig emergency power 34, for example. Also according to one or more embodiments of the present disclosure, the PLC 25 is configured to send instructions to the capacitor management system 42 to discharge the supercapacitor 40 if the power need of the hydraulic power unit 12 aligns with a first operational status of the hydraulic power unit 12. According to one or more embodiments of the present disclosure, the first operational status of the hydraulic power unit 12 may be start-up of the electric motor of the hydraulic power unit 12, an emergency mode of the hydraulic power unit 12, or any operational status of the hydraulic power unit 12 requiring a higher power demand than normal operations of the hydraulic power unit 12 in a non-emergency mode.

Still referring to FIG. 2, as previously described, the power management system 28 according to one or more embodiments of the present disclosure may also include at least one stored electrical energy system 44 for storing DC power. According to one or more embodiments of the present disclosure, the stored electrical energy system 44 may include a battery management system 46 connected to a battery pack 48, as shown in FIG. 2 for example. According to one or more embodiments of the present disclosure, the stored electrical energy system 44 may include a hydrogen fuel cell, for example. According to one or more embodiments of the present disclosure, the stored electrical energy system 44 may be in communication with the HMI 26 mounted on the skid 30 and/or to an additional HMI 26 that is not mounted to the skid 30, as shown in FIG. 2.

As also shown in FIG. 2, the PLC 25 of the control panel 24 mounted on the skid 30 is configured to send instructions to use the stored electrical energy system 44 if the power need of the hydraulic power unit 12 aligns with a second operational status of the hydraulic power unit 12. According to one or more embodiments of the present disclosure, the second operational status of the hydraulic power unit 12 is a normal operation of the hydraulic power unit 12 after start-up of the electric motor. According to one or more embodiments of the present disclosure, the first operational status of the hydraulic power unit 12, as previously described, may require a higher power demand than the second operational status of the hydraulic power unit 12, for example.

Still referring to FIG. 2, the pressure control equipment 16*a* in direct fluidic communication with the hydraulic power unit 12 may include at least one sensor 50 that monitors at least one condition, such as a wellbore condition, for example. According to one or more embodiments of the present disclosure, the at least one sensor 50 may include a pressure sensor, a flow sensor, a temperature sensor, a vibration sensor, a shock sensor, a position sensor, a proximity sensor, or a load sensor (LDVT), for example. According to one or more embodiments of the present disclosure, the PLC 25 of the control panel 24 is configured to process feedback received from the at least one sensor 50, and the PLC 25 is configured to evaluate the power need of the hydraulic power unit 12 based on the feedback. Based on the power need of the hydraulic power unit 12, the PLC 25 of the control panel 24 mounted on the skid 30 is configured to send instructions for controlling the capacitor management system 42 or to use the stored electrical energy system 44, as previously described.

Still referring to FIG. 2, an electric pressure control equipment system 14 according to one or more embodiments of the present disclosure may include a pressure control equipment 16*b* including an electric motor, and a control panel 24 including a drive controller. According to one or more embodiments of the present disclosure, the drive controller drives the electric motor of the pressure control equipment 16*b*. According to one or more embodiments of the present disclosure, the drive controller may include at least one starter 27, which may include at least one of a solid-state starter, an FVRN starter, and a variable frequency drive that is designed to limit inrush current to the electric motor of the pressure control equipment 16*b* so as to not overload the applicable power source (i.e., rig backup power 30, main power 32, or rig emergency power 34), for example. According to one or more embodiments of the present disclosure, the drive controller may include a backup starter in the event of a failure of one or more of the at least one starter 27 or the electric motor, for example.

Still referring to FIG. 2, the control panel 24 of the electric pressure control equipment system 14 may include a PLC 25, and the power management system 28 may be connected to the PLC 25 of the control panel 24, as previously described. In operation, for example, the PLC 25 of the control panel 24 mounted on the skid 30 is configured to evaluate a power need of the pressure control equipment 16*b* of the electric pressure control equipment system 14. According to one or more embodiments of the present disclosure, the PLC is configured to send instructions to the capacitor management system 42 to discharge the supercapacitor 40 if the power need of the pressure control equipment 16*b* exceeds a predetermined threshold. According to one or more embodiments of the present disclosure, the predetermined threshold may be substantially equal to a power rating or an available power amount of any of the main power source 32, the rig backup power 38, or the rig emergency power 34, for example. Also according to one or more embodiments of the present disclosure, the PLC 25 is configured to send instructions to the capacitor management system 42 to discharge the supercapacitor 40 if the power need of the pressure control equipment 16*b* aligns with a first operational status of the pressure control equipment 16*b*. According to one or more embodiments of the present disclosure, the first operational status of the pressure control equipment 16*b* may be start-up of the electric motor of the pressure control equipment 16*b*, an emergency mode of the pressure control equipment 16*b*, or any operational status of the pressure control equipment 16*b* requiring a higher power demand than normal operations of the pressure control equipment 16*b* in a non-emergency mode.

Still referring to FIG. 2, in another operational example, the PLC 25 of the control panel 24 mounted on the skid 30 is configured to send instructions to use the stored electrical energy system 44 if the power need of the pressure control equipment 16*b* aligns with a second operational status of the pressure control equipment 16*b*. According to one or more embodiments of the present disclosure, the second operational status of the pressure control equipment 16*b* is a normal operation of the pressure control equipment 16*b* after start-up of the electric motor. According to one or more embodiments of the present disclosure, the first operational status of the pressure control equipment 16, as previously described, may require a higher power demand than the second operational status of the pressure control equipment 16, for example.

Still referring to FIG. 2, the pressure control equipment 16*b* having the electric motor may include at least one sensor 50 that monitors at least one condition, such as a wellbore condition, for example. According to one or more embodiments of the present disclosure, the at least one sensor 50 may include a pressure sensor, a flow sensor, a temperature sensor, a vibration sensor, a shock sensor, a position sensor, a proximity sensor, or a load sensor (LDVT), for example. According to one or more embodiments of the present disclosure, the PLC 25 of the control panel is configured to process feedback received from the at least one sensor 50, and the PLC 25 is configured to evaluate the power need of the pressure control equipment 16*b* based on the feedback. Based on the power need of the pressure control equipment 16*b*, the PLC 25 of the control panel 24 mounted on the skid 30 is configured to send instructions for controlling the capacitor management system 42 or to use the stored electrical energy system 44, as previously described.

Figure 3:
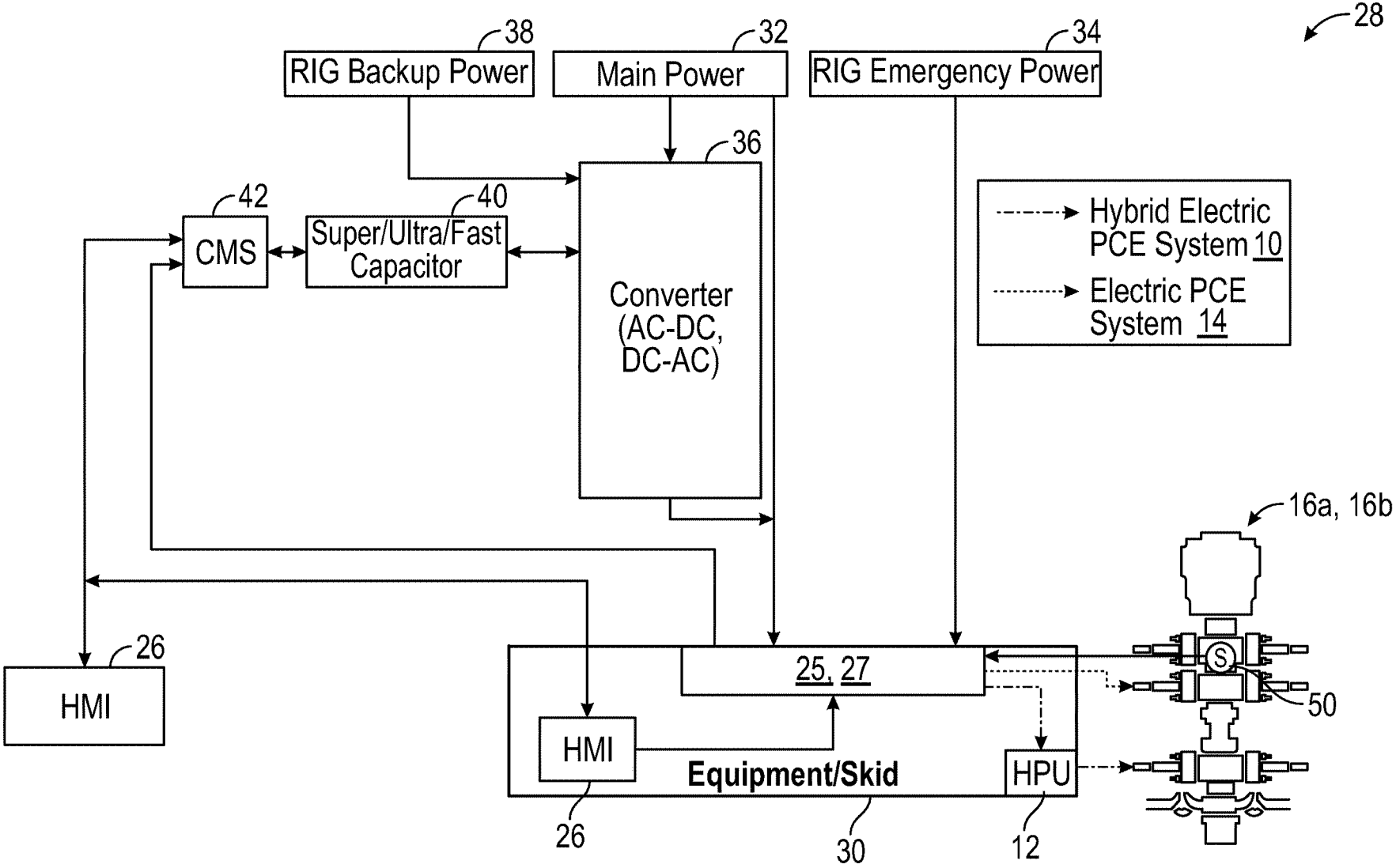
FIG. 3 shows a schematic diagram of an electric power management system according to one or more embodiments of the present disclosure.

Referring now to FIG. 3, a schematic diagram of a power management system 28 according to one or more embodiments of the present disclosure is shown. The schematic diagram shown in FIG. 3 is similar to that previously described with respect to FIG. 2 except that the schematic diagram shown in FIG. 3 does not include a stored electrical energy system 44 electrically connected to the inverter 36 for storing DC power and in electrical communication with the PLC 25 of the control panel 24. Indeed, the power management system 28 according to one or more embodiments of the present disclosure may or may not include a stored electrical energy system 44 along with the capacitor management system 42.

Figure 4:
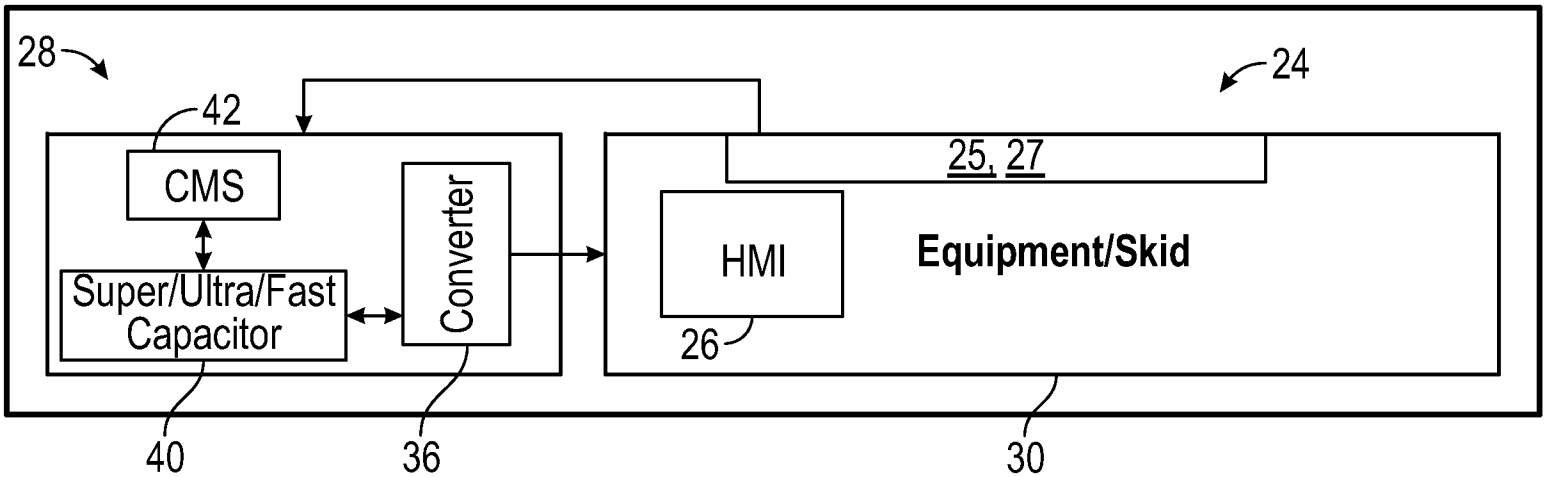
FIG. 4 shows a schematic diagram of an electric power management system according to one or more embodiments of the present disclosure.

Referring now to FIG. 4, a schematic diagram of a power management system 28 according to one or more embodiments of the present disclosure is shown. As shown in FIG. 4, in one or more embodiments of the present disclosure, at least a portion of the power management system and the skid 30 having the control panel 24 and HMI 26 mounted thereon may be disposed in the same zone. For example, at least the inverter 36, the capacitor management system 42, and the capacitor 40 of the power management system 28 may be disposed in the same zone as the control panel 24 and the HMI 26 mounted on the skid. In this way, at least a portion of the power management system 28 and the equipment mounted on the skid 30 may be integrated into a sealed design and configured to operate in a safe rated area, a hazardous rated area, or a combination of these.

Advantageously, the PLC 25, in cooperation with the power management system 28, is able to evaluate a power need of the hybrid electric pressure control equipment system 10 or the electric pressure control equipment system 14, as the case may be, and discharge the supercapacitor 40 using the capacitor management system 42 for on-demand rapid power or high-power density needs for short term requirements of the system, and use the stored electrical energy system 44 to support lower power needs or longer term use of the system in one or more embodiments of the present disclosure.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system comprising:
a pressure control equipment;
a hydraulic power unit comprising:
a fluid reservoir; and
at least one pump comprising an electric motor configured to power the pump;
a programmable logic controller (PLC) in electric communication with the hydraulic power unit; and
a power management system connected to the PLC, wherein the power management system comprises:
a capacitor management system connected to a supercapacitor; and
a stored electrical energy system,
wherein the at least one pump of the hydraulic power unit is in direct fluidic communication with the pressure control equipment,
wherein the PLC is configured to evaluate a power need of the hydraulic power unit,
wherein the PLC is configured to send instructions to discharge the supercapacitor if the power need of the hydraulic power unit aligns with a first operational status of the hydraulic power unit,
wherein the PLC is configured to send instructions to use the stored electrical energy system if the power need of the hydraulic power unit aligns with a second operational status of the hydraulic power unit, and
wherein the first operational status requires a higher power demand than the second operational status.

2. The system of claim 1, wherein the pressure control equipment comprises a blowout preventer stack.

3. The system of claim 1, wherein the stored electrical energy system comprises a battery management system connected to a battery pack.

4. The system of claim 1, wherein the stored electrical energy system comprises a hydrogen fuel cell.

5. The system of claim 1, wherein the power management system is connected to the PLC via a bi-directional converter of the power management system, wherein the bi-directional converter is electrically connected to the supercapacitor.

6. The system of claim 5, wherein the bi-directional converter is electrically connected to the stored electrical energy system.

7. The system of claim 1, wherein the first operational status of the hydraulic power unit is start-up of the electric motor.

8. The system of claim 7, wherein the second operational status of the hydraulic power unit is normal operation of the hydraulic power unit after start-up of the electric motor.

9. The system of claim 1, wherein the first operational status of the hydraulic power unit is an emergency mode.

10. The system of claim 9, wherein the second operational status of the hydraulic power unit is normal operation of the hydraulic power unit in a non-emergency mode.

11. The system of claim 1, further comprising:
at least one of a solid-state starter or a variable frequency drive that is configured to control inrush current to the electric motor.

12. The system of claim 1, further comprising:
at least one human machine interface connected to the capacitor management system, wherein the at least one human machine interface is in electric communication with the PLC.

13. The system of claim 1, further comprising:

at least one human machine interface connected to the capacitor management system and the stored electrical energy system, wherein the at least one human machine interface is in electric communication with the PLC.

14. The system of claim 1, wherein the pressure control equipment comprises at least one sensor that monitors at least one condition, wherein the PLC is configured to process feedback received from the at least one sensor, and wherein the PLC is configured to evaluate the power need of the hydraulic power unit based on the feedback.

15. The system of claim 14, wherein the at least one condition is at least one wellbore condition.

* * * * *